US005829249A

United States Patent [19]

VanRens

[11] Patent Number: 5,829,249

[45] Date of Patent: Nov. 3, 1998

[54] INTERNAL COMBUSTION ENGINE WITH EXHAUST PASSAGE AND REACTOR HAVING A COMMON WALL

[75] Inventor: Russell J. VanRens, Milwaukee, Wis.

[73] Assignee: Outboard Marine Corporation, Waukegan, Ill.

[21] Appl. No.: 589,038

[22] Filed: Jan. 19, 1996

[51] Int. Cl.[6] ..... F01N 3/28

[52] U.S. Cl. ..... 60/298; 60/302; 60/321; 60/323

[58] Field of Search ..... 60/282, 298, 302, 60/321, 323

[56] References Cited

U.S. PATENT DOCUMENTS

| | | | |
|---|---|---|---|
| 3,918,258 | 11/1975 | Gaschler | 60/282 |
| 4,086,763 | 5/1978 | Matsushita | 60/282 |
| 4,091,616 | 5/1978 | Loweg | 60/302 |
| 4,735,046 | 4/1988 | Iwai | 60/295 |
| 4,900,282 | 2/1990 | Takahashi et al. | 440/89 |
| 5,203,167 | 4/1993 | Lassanske et al. | 60/298 |
| 5,239,825 | 8/1993 | Shibata | 60/302 |
| 5,306,185 | 4/1994 | Lassanske et al. | 440/89 |
| 5,433,073 | 7/1995 | Duret | 60/302 |

FOREIGN PATENT DOCUMENTS

| | | | |
|---|---|---|---|
| 2245506 | 1/1992 | United Kingdom | 60/302 |

*Primary Examiner*—Douglas Hart
*Attorney, Agent, or Firm*—Jones, Day, Reavis & Pogue

[57] ABSTRACT

Disclosed herein is an internal combustion engine including a reactor including opposed first and second ends, an outer shell extending between the opposed ends, and a flow path extending between the opposed ends and including an entry opening at the first end, and a discharge opening at the second end, and an engine member including a plurality of spaced combustion chamber portions each including an exhaust port, an exhaust manifold communicating with the exhaust ports and with the entry opening and including a generally vertically extending open side including a portion closed by the reactor outer shell, and an outer wall spaced from the open side of the manifold and also engaging the outer shell of the reactor.

18 Claims, 2 Drawing Sheets

INTERNAL COMBUSTION ENGINE WITH EXHAUST PASSAGE AND REACTOR HAVING A COMMON WALL

BACKGROUND OF THE INVENTION

The invention relates generally to internal combustion engines and, more particularly, to such engines which include an exhaust gas reactor through which all of the exhaust gas passes. The invention is also applicable to two-stroke and to four-stroke engines.

Attention is directed to the following U.S. Pat. Nos.

4,735,046, issued Apr. 5, 1988

4,900,282, issued Feb. 13, 1990

5,203,167, issued Apr. 20, 1993

5,306,185, issued Apr. 26, 1994

SUMMARY OF THE INVENTION

The invention provides an internal combustion engine including a reactor including opposed first and second ends, an outer shell extending between the opposed ends, and a flow path extending between the opposed ends and including an entry opening at the first end, and a discharge opening at the second end, and an engine member including a plurality of spaced combustion chamber portions each including an exhaust port, an exhaust manifold communicating with the exhaust ports and with the entry opening and including an open side including a portion closed by the reactor outer shell, and an outer wall spaced from the open side of the manifold and also engaging the outer shell of the reactor.

The invention also provides an internal combustion engine including a reactor including an outer shell defining a flow path including an entry opening and a discharge opening, and a cast engine member including a plurality of spaced combustion chambers each including an exhaust port, an exhaust manifold communicating with said exhaust ports and with said entry opening and including an open side including a portion closed by said reactor outer shell, and an outer wall spaced from said open side of said manifold and also engaging said outer shell of the reactor.

The invention also provides an internal combustion engine including a reactor including an outer wall defining a vertical flow path including a top entry opening and a lower discharge opening, and a cast member including a plurality of combustion chamber portions located in vertical alignment and each including an exhaust port, an exhaust manifold communicating with the exhaust ports and including a bottom wall extending to the reactor from the lower combustion chamber portion so as to close the bottom of the manifold, a top wall extending to the reactor from the upper combustion chamber portion in spaced relation above the top entry opening so as to close the top of the manifold while affording exhaust gas flow from the manifold to the top entry opening of the reactor flow path, and including an outer lower end, and an open side located intermediate the bottom wall and the top wall and in generally opposing relation to the exhaust ports and including a lower portion closed by the reactor outer wall, and an outer vertical wall spaced horizontally from the open side of the manifold, extending from the outer lower end of the top wall, and engaging the outer wall of the reactor, and an additional outer wall including a first portion located in generally spaced relation to the first mentioned outer wall and to the top wall to define a coolant jacket therearound and a second portion located in generally spaced relation to the combustion chamber portions to define a coolant jacket therearound.

Other features and advantages of the invention will become apparent to those skilled in the art upon review of the following detailed description, claims and drawings.

Figure 1:
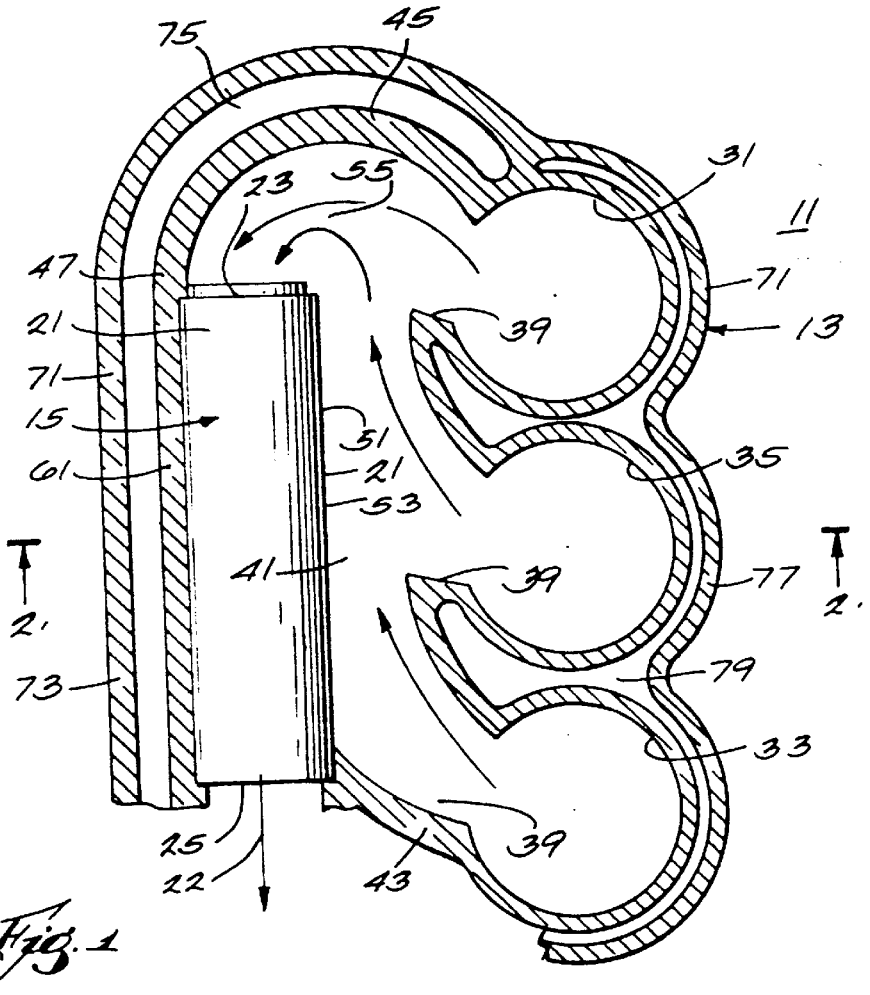
FIG. 1 is a fragmentary sectional view of an internal combustion engine embodying various of the features of the invention.
Figure 2:
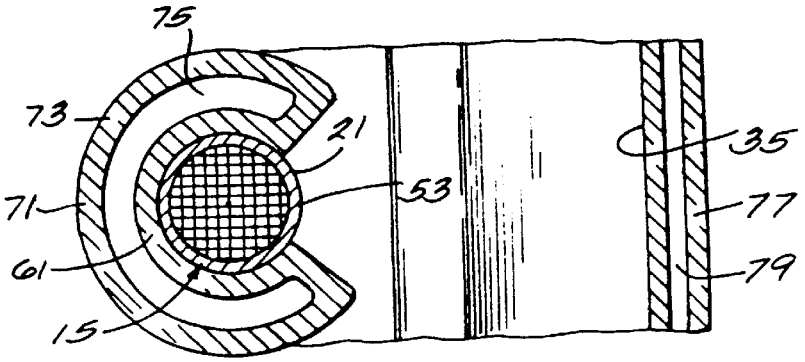
FIG. 2 is a sectional view taken along line 2—2 of FIG. 1.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is understood that the phraseology and terminology used herein is for the purpose of description and should not be regarded as limiting.

DESCRIPTION OF THE PREFERRED EMBODIMENT

Shown fragmentarily in FIG. 1 is an internal combustion engine 11 including a cast engine block member 13 and an exhaust gas reactor 15 which can be fixed in the cast member 13 incident to casting thereof or which can be assembled into the cast member 13 (after casting thereof) in any suitable manner, such as by press-fitting. The internal combustion engine 11 can be either a two-stroke engine or a four-stroke engine and the cast engine block member 13 can be either a cylinder block member or a cylinder head member.

The reactor 15 can be constructed in any conventional manner, is arranged vertically in the cast member 13, and includes an outer shell or wall 21 which is preferably fabricated of heat resistant material, and which defines a vertical exhaust gas reactor flow path (illustrated by the arrow 22). The reactor flow path 22 includes an upper or top end entry opening 23 and a lower or bottom end discharge opening 25.

The cast engine member 13 is fabricated from a low melting point alloy, such as aluminum or magnesium, and includes a plurality of combustion chamber portions or cylinders. In the embodiment illustrated in FIG. 1, the engine member 13 is a cylinder block including a plurality of horizontal cylinders which are located in vertical alignment. In the illustrated construction, there are three cylinders, an upper cylinder 31, a lower cylinder 33, and an intermediate cylinder 35, each cylinder including an exhaust port 39.

Figure 3:
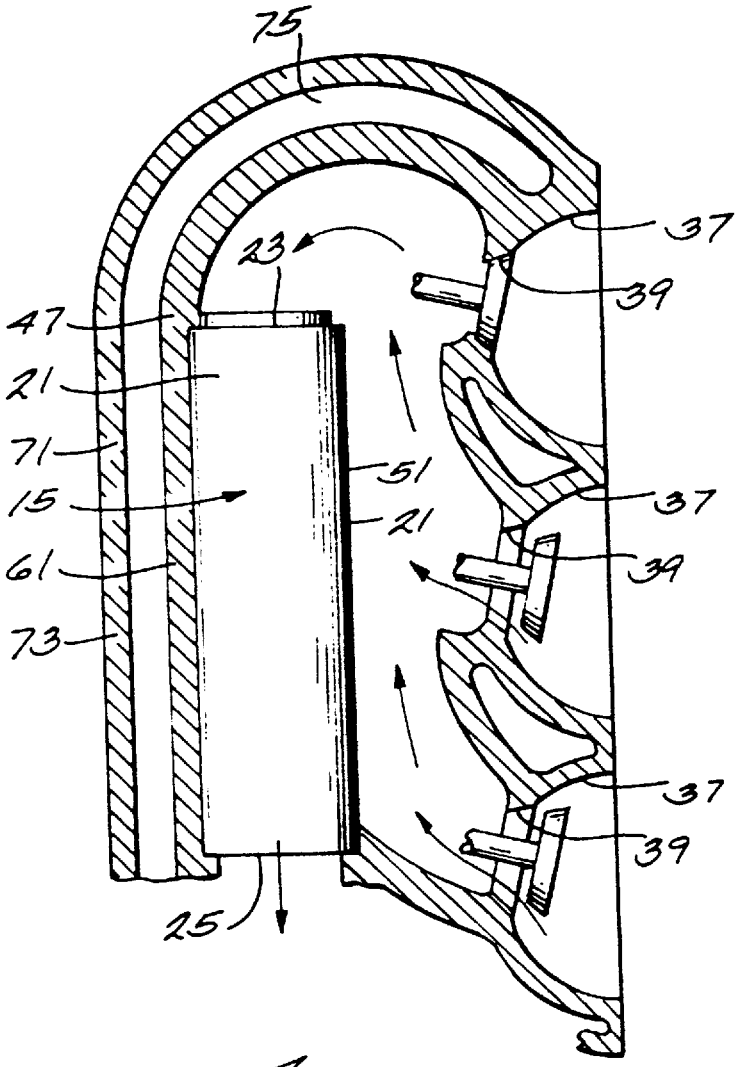
FIG. 3 is a fragmentary sectional view of another embodiment of an internal combustion engine embodying various of the features of the invention.

In another embodiment illustrated in FIG. 3, the engine member 13 is a cylinder head including a plurality of dome-shaped combustion chamber portions or recesses 37.

The cast engine member 13 illustrated in FIG. 1 also includes an exhaust gas manifold 41 communicating with the exhaust ports 39 and including (or defined by) a bottom wall 43 extending to the reactor outer shell 21 from the lower cylinder 33 so as to close the bottom of the manifold 41. The exhaust gas manifold 41 is also defined by or includes an arcuate top wall 45 extending to the reactor 15 from the upper cylinder 31 in spaced relation above the top entry opening 23 so as to close the top of the manifold 41, while also affording exhaust gas flow from the manifold 41 to the top entry opening 23 of the reactor flow path 22. As shown, the top wall 45 includes an outer lower end 47 which engages with the reactor outer shell 21 adjacent the top end thereof.

The manifold 41 also is defined by or includes an open side 51 located intermediate the bottom wall 43 and the top wall 45 and in generally opposing relation to the exhaust gas ports 39 and including a lower portion 53 closed by the reactor outer wall or shell 21. The open side 51 of the manifold 41 also includes an open upper portion 55 through which the exhaust gas flows to the top entry opening 23 of the reactor 15.

In addition, the engine member 13 includes an outer vertical wall 61 which is spaced horizontally from the open side 51 of the manifold 41, which extends from the outer lower end 47 of the top wall 45 and from the bottom wall 43, and which engages or embraces a substantial portion of the outer wall or shell 21 of the reactor 15 so as to enable, if appropriate, press-fitting of the reactor 15 into the engine member 13.

Still further, the engine member 15 also includes an additional outer wall 71 including a first portion 73 located in generally spaced relation to the first mentioned outer wall 61 and to the top wall 45 to define a coolant jacket 75 therearound, and a second portion 77 located in generally spaced relation to the cylinders 31, 33, and 35 to define a coolant jacket 79 therearound.

In operation, the exhaust gas exits the exhaust ports 39 of the cylinders 31, 33, and 35, then travels upwardly in the exhaust gas manifold 41 to the top end entry opening 23 of the reactor 15. The exhaust gas then travels vertically downwardly through the reactor 15 and is discharged through the lower end discharge opening 25 for ultimate discharge from the engine 11.

As a consequence of the above described construction, the outer wall or shell 21 of the reactor 15 constitutes a common wall between the reactor 15 and the exhaust gas manifold 41. The common wall between the reactor 15 and the exhaust gas manifold 41 thus provides a casting and reactor assembly which is smaller and lighter. Furthermore, the common wall facilitates more rapid heating of the reactor 15, thus "lighting off" the reactor 15 more rapidly. Still further, as the outer wall or shell 21 is formed of heat resistant material, the outer wall or shell 21 of the reactor 15, i.e., the common wall, need not be water jacketed. This is particularly important when the cast member 13 is of a low melting point alloy, such as aluminum or magnesium.

Various of the features of the invention are set forth in the following claims.

I claim:

1. An internal combustion engine including a reactor including opposed first and second ends, an outer shell extending between the opposed ends, and a flow path extending between the opposed ends and including an entry opening at the first end, and a discharge opening at the second end, and an engine member including a plurality of spaced combustion chamber portions each including an exhaust port, an exhaust manifold communicating with the exhaust ports and with the entry opening and including an open side including a portion closed by the reactor outer shell, and an outer wall spaced from the open side of the manifold and also engaging the outer shell of the reactor.

2. An internal combustion engine in accordance with claim 1 wherein the outer shell of the reactor is fabricated of heat resistant material.

3. An internal combustion engine in accordance with claim 1 wherein the engine member is a cylinder block.

4. An internal combustion engine in accordance with claim 1 wherein the engine member is a cylinder head.

5. An internal combustion engine in accordance with claim 1 wherein the reactor is cast-in the engine member.

6. An internal combustion engine in accordance with claim 1 wherein the reactor is assembled into the engine member.

7. An internal combustion engine including a reactor including an outer shell defining a flow path including an entry opening and a discharge opening, and a cast engine member including a plurality of spaced combustion chambers each including an exhaust port, an exhaust manifold communicating with the exhaust ports and with the entry opening and including an open side including a portion closed by the reactor outer shell, and an outer wall spaced from the open side of the manifold and also engaging the outer shell of the reactor.

8. An internal combustion engine in accordance with claim 7 wherein the outer shell of the reactor is fabricated of heat resistant material.

9. An internal combustion engine in accordance with claim 7 wherein the cast member is a cylinder block.

10. An internal combustion engine in accordance with claim 7 wherein the cast member is a cylinder head.

11. An internal combustion engine in accordance with claim 7 wherein the reactor is cast-in the cast member.

12. An internal combustion engine in accordance with claim 7 wherein the reactor is assembled into the cast member.

13. An internal combustion engine including a reactor including an outer wall defining a vertical flow path including a top entry opening and a lower discharge opening, and a cast member including a plurality of combustion chamber portions located in vertical alignment and each including an exhaust port, an exhaust manifold communicating with the exhaust ports and including a bottom wall extending to the reactor from the lower combustion chamber portion to close the bottom of the manifold, a top wall extending to the reactor from the upper combustion chamber portion in spaced relation above the top entry opening so as to close the top of the manifold while affording exhaust gas flow from the manifold to the top entry opening of the reactor flow path, and including an outer lower end, and an open side located intermediate the bottom wall and the top wall and in generally opposing relation to the exhaust ports and including a lower portion closed by the reactor outer wall, and an outer vertical wall spaced horizontally from the open side of the manifold, extending from the outer lower end of the top wall, and engaging the outer wall of the reactor, and an additional outer wall including a first portion located in generally spaced relation to the first mentioned outer wall and to the top wall to define a coolant jacket therearound and a second portion located in generally spaced relation to the combustion chamber portions to define a coolant jacket therearound.

14. An internal combustion engine in accordance with claim 13 wherein the outer wall of the reactor is fabricated of heat resistant material.

15. An internal combustion engine in accordance with claim 13 wherein the cast member is a cylinder block.

16. An internal combustion engine in accordance with claim 13 wherein the cast member is a cylinder head.

17. An internal combustion engine in accordance with claim 13 wherein the reactor is cast-in the cast member.

18. An internal combustion engine in accordance with claim 13 wherein the reactor is assembled into the cast member.

* * * * *